US009346641B2

(12) United States Patent
Herrmann

(10) Patent No.: US 9,346,641 B2
(45) Date of Patent: May 24, 2016

(54) SYSTEMS AND METHODS FOR IMPLEMENTING ADVANCED VACUUM BELT TRANSPORT SYSTEMS

(71) Applicant: XEROX Corporation, Norwalk, CT (US)

(72) Inventor: Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/446,353

(22) Filed: Jul. 30, 2014

(65) Prior Publication Data

US 2016/0031663 A1 Feb. 4, 2016

(51) Int. Cl.

| | |
|---|---|
| ***B65H 3/12*** | (2006.01) |
| ***B65H 5/22*** | (2006.01) |
| ***B41J 11/00*** | (2006.01) |

(52) U.S. Cl.

CPC ..... *B65H 5/224* (2013.01); *B41J 11/007* (2013.01)

(58) Field of Classification Search

CPC ..... B65H 3/12; B65H 3/124; B65H 29/16; B65H 29/242; B65H 29/247; B65H 5/22; B65H 5/228; B65H 29/24

USPC ..... 271/90, 11, 94, 96, 275, 276, 195

See application file for complete search history.

(56) References Cited

U.S. PATENT DOCUMENTS 3,271,024 A * 9/1966 May ..... 271/94
4,771,896 A * 9/1988 Newsome ..... 271/3.03

* cited by examiner

*Primary Examiner* — Thomas Morrison
(74) *Attorney, Agent, or Firm* — Ronald E. Prass, Jr.; Prass LLP

(57) ABSTRACT

A system and method are provided for implementing more consistent vacuum belt transport movement for the transport of image receiving media in image forming devices, and for the transport of packages and components for processing and storage in myriad transport belt systems employing vacuum plenums to support and secure the materials being transported on the vacuum belts. A high-velocity stream of forced air is provided in a plenum positioned between the vacuum belt and the underlying structural components to create an area of low pressure to hold the media to the opposite side of the vacuum belt. The high-velocity air layer not only creates a pressure differential to support the vacuum pressure, but also provides an air bearing below the vacuum belt between the vacuum belt and the underlying structural components to allow the vacuum belt to move easily over the underlying structural components.

17 Claims, 4 Drawing Sheets

SYSTEMS AND METHODS FOR IMPLEMENTING ADVANCED VACUUM BELT TRANSPORT SYSTEMS

BACKGROUND

1. Field of the Disclosed Embodiments

This disclosure relates to systems and methods for implementing more consistent vacuum belt transport movement for the transport of image receiving media in image forming devices, and for the transport of packages and components for processing and storage in myriad transport belt systems employing vacuum plenums to support and secure the materials being transported on the vacuum belts.

2. Related Art

Many industries use component transport belt systems in order to transport individual packages, components and the like between and through package and/or component processing devices, or within, for example, warehouse structures for storage or delivery. The vacuum belts used in certain vacuum belt transport systems may be perforated with holes that facilitate the application of a vacuum pressure from one or more vacuum plenums located beneath the vacuum belt over at least a portion of the transport path traversed by the vacuum belt in the vacuum belt transport system. Such configurations are intended to aid in precisely and/or securely positioning and holding the individual packages, components and the like on the vacuum belt to support package and/or component processing, or to securely transporting individual packages, components and the like over at least a portion of the transport path of the vacuum belt transport system.

In image forming devices, such vacuum and vacuum-aided belt transport systems may be employed to precisely hold sheets of image receiving media, particularly large sheets of image receiving media, to a vacuum belt transport mechanism to support precise image forming and finishing operations in the image forming devices. In order to illustrate the precision required, consider image forming on a sheet of image receiving media using one or more stationary inkjet print heads as the marking unit in the image forming device. The sheet of image receiving media is translated past the one or more stationary inkjet print heads by the perforated vacuum belt to which the sheet of image receiving media is held in the vacuum belt transport system. In order to avoid mis-registration or other image quality errors, the movement of the sheet of image receiving media past the inkjet print head must be precisely controlled. A speed of movement of the sheet of image receiving media must be constant. Movement of the sheet of image receiving media cannot be accelerated, decelerated, or jittered based on random excursions in transport belt movement in the vacuum belt transport system.

Difficulties may arise as differing sizes, compositions and/or numbers of image receiving media substrates are transported on a vacuum transport belt in the image forming device. It can be well understood that, as numbers and sizes of image receiving media substrates to be transported by a vacuum transport belt are varied, overall vacuum pressures to which the vacuum transport belt/substrate combinations may be subjected, over at least a portion of the movement of the vacuum transport belt in the vacuum belt transport system, will vary. These varying vacuum pressures may introduce different levels of frictional force or frictional loading within the vacuum belt transport system. The vacuum belt, for example, may be differently pulled, under varying vacuum pressure forces, against underlying structural components within the vacuum belt transport system. Based on an elasticity, or flexibility, in the vacuum belt, the frictional forces introduced underneath the vacuum belt may cause the vacuum belt to randomly stretch and/or surge resulting in the random excursions in vacuum transport belt movement which may be detrimental to image quality in the produced images in the image forming device.

The resulting differing levels of frictional forces that may be introduced in this manner must be reasonably and/or completely compensated for with the vacuum belt drive components in the vacuum belt transport system. Such compensation may require, for example, complicated vacuum belt drive feedback solutions. Failure to provide detection of, and compensation for, such random excursions in vacuum transport belt movement will result in detrimentally adverse effects on the quality for the images formed on the image receiving media substrates transported by the vacuum belt transport system.

In the context of individual package transport within a factory, processing or warehouse facility over massive and/or extensive vacuum belt transport systems, it can be readily extrapolated from the above discussion that introduction of additional friction forces across portions of an expansive vacuum belt transport system may produce equally detrimental effects. Timing for individual packages or components reaching certain processing stations may be adversely affected. Timing for individual packages being delivered to output bins or stations may be equally adversely affected. Further, and somewhat more insidious, individual components within the vacuum belt transport system may be subject to differential and/or accelerated wear causing one or more of those individual components to prematurely fail, or to at least require more frequent replacement based on adverse effects on the life cycle of the individual components. While it is true that these effects may be mitigated by over-engineering such more expansive vacuum belt transport systems, there is a cost associated with that over-engineering as well.

Very simply described then, difficulties in vacuum belt transport systems can arise based on a number of physical factors. When transporting large media or multiple media items on a vacuum belt in a vacuum belt transport system, especially on longer vacuum belts, the normal forces created by the vacuum results is increased force between the back side of the vacuum belt and various underlying components including, but not limited to, the vacuum belt guides or guide structure. As more media is added to the vacuum belt, and/or the vacuum belt gets longer, or the sheets get larger, a vacuum belt to guide structure force continues to increase and causes several issues. This force drives up the frictional load on the vacuum belt, which then requires increased torque from the one or more drive motors in the vacuum belt transport system. Motion profiles are affected by the changes in load. Traditional elastomer vacuum belts tend to stretch under the increased loads. An example where such difficulties may particularly manifest themselves may be in systems in which individual vacuum belts are used as part of a parallel vacuum belt transport system. Uneven movement differentially introduced between the individual vacuum belts in the parallel vacuum belt transport system, based on individual vacuum belt deformation/stretch and/or frictional forces causing uneven motion profiles between the vacuum belts, will lead to differential vacuum belt timing issues and consequential skew in the products transported on the vacuum belts.

In summary, expansive vacuum belt transport systems may require additional power to compensate for the frictional forces introduced by vacuum loading across the expanse of the vacuum belt transport systems. Image forming devices may sacrifice image quality based on the frictional forces introduced by vacuum loading across the vacuum belt transport systems. Regardless of how the detrimental effects of frictional forces manifest themselves, productivity can generally be adversely affected in such vacuum belt transport related systems.

SUMMARY OF DISCLOSED SUBJECT MATTER

Based on the above-described shortfalls in the conventional vacuum belt transport systems, it may be advantageous to find some manner by which to more consistently account for additive frictional forces introduced throughout such vacuum belt transport systems. It may be further advantageous to implement systems and methods by which to reduce or substantially eliminate potential impacts of the frictional forces in vacuum belt transport systems.

Exemplary embodiments of the systems and methods according to this disclosure may address the above-described variable-force loading issues by achieving media hold down to a vacuum belt in a vacuum belt transport system by implementing a unique airflow/vacuum system within the vacuum belt transport system.

Exemplary embodiments may achieve the media hold down by directing a high-velocity stream of forced air in a plenum positioned between the vacuum belt and the underlying structural components including belt guides in a manner that may create an area of lower pressure under the vacuum belt. The created area of low pressure may be used to hold the media to the opposite side of the vacuum belt with the higher pressure applied to the media.

In embodiments, a pressure differential may be applied to the media via the vacuum holes or perforations in the vacuum belt.

Exemplary embodiments may improve upon traditional vacuum belt transport systems in which a negative air pressure (vacuum) system is used to hold the media to the vacuum belt. Exemplary embodiments effectively employ a pressure differential caused by a thin and high-velocity layer of air directed on the opposite side of the vacuum belt.

Exemplary embodiments may advantageously employ the high-velocity air layer to not only create a pressure differential to support the vacuum pressure described above, but also to provide an air bearing below the vacuum belt between the vacuum belt and the underlying structural components that may allow the vacuum belt to continue to move easily over the underlying structural components, including the belt guides, thereby essentially eliminating added frictional forces that may have been conventionally introduced when the media size and/or number of pieces of individual media increases. In this manner, the additional frictional loadings associated with traditional vacuum belts may be substantially eliminated by the air bearing caused by the high-velocity air stream below the vacuum belt.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for implementing more consistent vacuum belt transport movement for the transport of image receiving media in image forming devices, and for the transport of packages and components for processing and storage in myriad vacuum belt transport systems employing vacuum plenums to support and secure the materials being transported on the vacuum belts according to this disclosure, will be described, in detail, with reference to the following drawings, in which.

DETAILED DESCRIPTION OF THE DISCLOSED EMBODIMENTS

Figure 1:
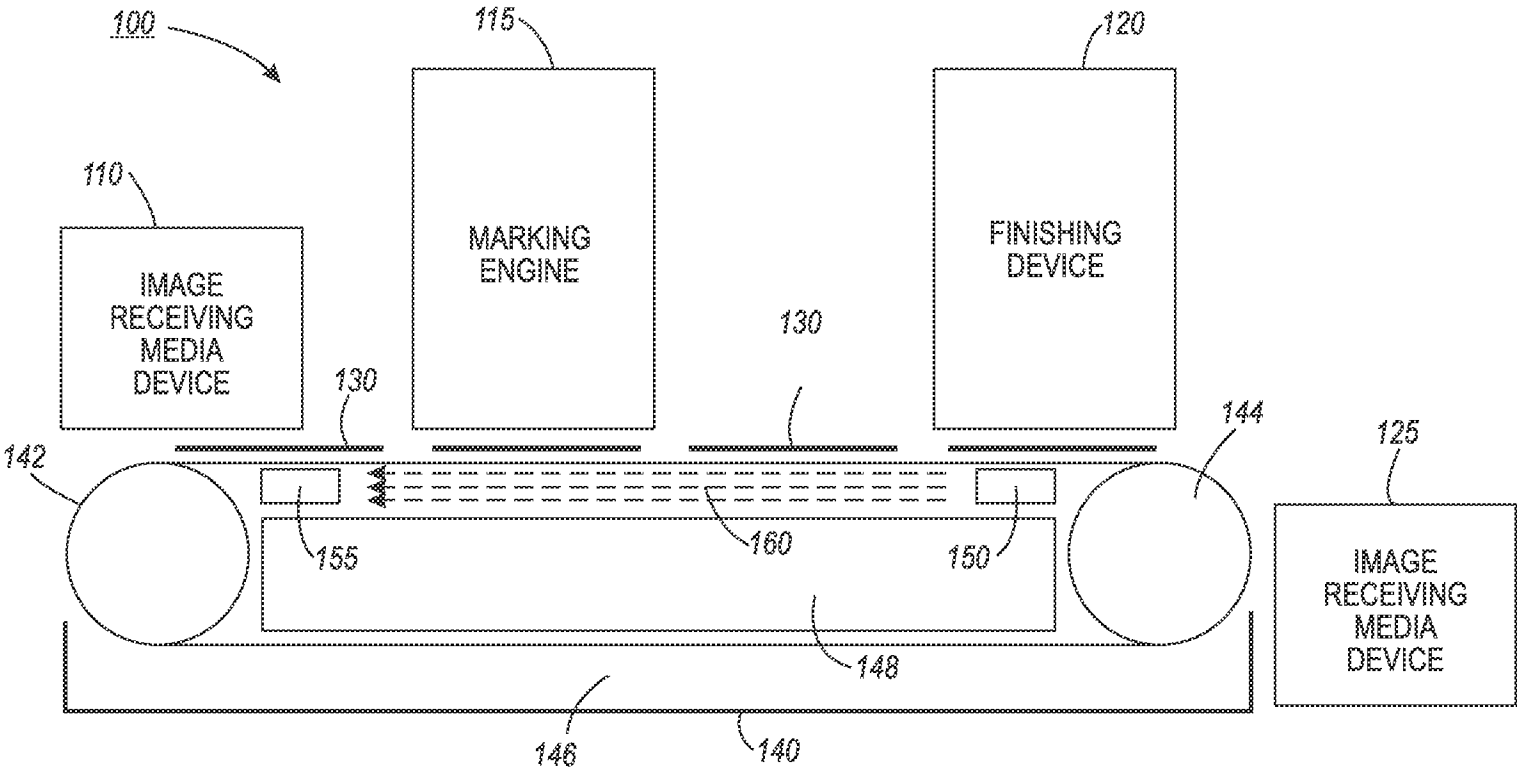
FIG. 1 illustrates a block diagram of an exemplary image forming system including an advanced vacuum belt transport system according to this disclosure.

The systems and methods for implementing more consistent vacuum belt transport movement for the transport of image receiving media in image forming devices, and for the transport of packages and components for processing and storage in myriad vacuum belt transport systems employing vacuum plenums to support and secure the materials being transported on the vacuum belts according to this disclosure will generally refer to these specific utilities for those systems and methods. Exemplary embodiments described and depicted in this disclosure should not be interpreted as being specifically limited to any particular configuration a vacuum belt, a vacuum belt drive system, any processing device, including an image forming device, within which a vacuum belt transport system may be operated, or according to any other like limitation. It should be recognized that any advantageous use of the system and methods for applying Bernoulli's principle to facilitate rendering a vacuum through a perforated vacuum belt in order to transport any media, packaging, component or the like in a controlled manner via a vacuum belt transport system employing devices and methods such as those discussed in detail in this disclosure is contemplated.

The systems and methods according to this disclosure will be described as being particularly adaptable to use for image receiving media transport in image forming devices. These references are meant to be illustrative only in providing a single real-world utility for the disclosed systems and methods, and should not be considered as limiting the disclosed systems and methods to any particular product or combination of devices, or to any particular type of image forming device in which the described and depicted vacuum belt transport systems may be used. Any commonly-known processor-controlled image forming device in which the processor may direct movement of any selected image receiving media along a transport path for the image receiving media that includes, in at least one portion, a vacuum belt transport system that may be adapted according to the specific capabilities discussed in this disclosure is contemplated.

The disclosed embodiments replace traditional vacuum plenums with high-velocity forced air systems to create a laminar flow of high-velocity air under the perforated vacuum belt, and more specifically between the perforated vacuum belt and the underlying structural components, including one or more belt guides. The high-velocity forced air may be in a thin layer between the perforated vacuum belt and the underlying structural components. The high-velocity forced air may be channeled through the space by being introduced via a high-velocity forced air supply system including a fan or system of fans, and may be exhausted at an opposite end of a flow channel through vents or other similar forced air evacuation devices. In embodiments, the high-velocity forced air may be channeled across the space by being introduced via some combination of fans, manifolds and/or plenums at virtually any angle relative to the direction of movement of the vacuum belt of the vacuum belt transport system.

The disclosed embodiments may, therefore, aid in overcoming the above-discussed shortfalls in the prior art conventional vacuum transport belt systems. The disclosed embodiments may transport media in an accurate and controlled manner as the vacuum belts work well to secure the media to the vacuum belt surface. If the transport is made up of several parallel vacuum belts, the vacuum belts will stretch differently and misalignment of the vacuum belt and associated media results. U.S. Pat. No. 8,413,794 describes a compensating system that requires special tensioning systems in an attempt to control the variation in stretch among the disclosed three parallel vacuum transport belts.

The disclosed embodiments create the media hold down force, not through the application of a conventional vacuum, but rather by achieving vacuum pressure as a result of a pressure differential created by applying a high-velocity forced air layer on a side of the vacuum belt opposite the transport surface of the vacuum belt in a direction that is orthogonal to axes of the openings in the vacuum belt. By creating a high velocity air stream on the opposite side of the vacuum belt, the air pressure below the media becomes less than the atmospheric pressure above the media. This results in the media being pressed against the vacuum belt which is then driven by the resulting friction between the belt surface and the media itself.

As alluded to above, the high-velocity air may be directed in any direction with respect to the transport direction of the vacuum belt. In embodiments, the high-velocity air may be directed in a direction opposite to the transport direction of the vacuum belt in order to ensure that the velocity of the vacuum belt does not reduce the vacuum force by reducing the velocity differential between the vacuum belt and the high-velocity air. The high-velocity air may be forced in the opposite direction of the transport direction of the vacuum belt in order that the relative velocity of the high-velocity forced air is the result of the velocity of the transport belt plus the velocity of the air movement. High-velocity air supply input location(s), velocity(ies), and number(s) of inputs may be optimized for belt length/width and standard or variable media loading.

For reference, the following Bernoulli-based equations specify exemplary calculated differential pressures defined by air velocities:

$$\frac{V_1^2}{2g_c} + \frac{P_1}{\rho_1} + z_1 = \frac{V_2^2}{2g_c} + \frac{P_2}{\rho_2} + z_2 \qquad \text{Equation 1}$$

$$V_2 = V_{Belt} + V_{Forced\ Air} \qquad \text{Equation 2}$$

$$\frac{V_1^2}{2g_c} + \frac{P_1}{\rho_1} + z_1 = \frac{(V_{Belt} + V_{Forced\ air})^2}{2g_c} + \frac{P_2}{\rho_2} + z_2 \qquad \text{Equation 3}$$

Where:

$V_1$=Velocity of the ambient air above the belt which is at a low velocity;

$V_2$=Total Relative Velocity of the air below the belt in the opposite direction of the belt motion which is the summation of belt speed and forced air speed below the belt defined as $V_{Belt}+V_{forced\ air}$;

$V_{Belt}$=Velocity of the belt;

$V_{Forced\ Air}$=Velocity of the air injected below the belt (or at least a vector component of the injected air in a direction opposite to the direction of the movement of the belt);

$g_c$=Gravitational constant;

$P_1$=Pressure above the belt $P_2$=Pressure below the belt;

$\rho_1$=Density of air above the belt (Air density assumed to be equal based on lack of compression);

$\rho_2$=Density of air below the belt;

$z_1$=Height of fluid (Height is assumed to be equal); and $z_2$=Height of fluid.

Based on this, $z_1=z_2$ and $\rho_1=\rho_2$ so as $V_2$ is increased compared to $V_1$, the pressure below the vacuum belt, $P_2$, drops compared to the pressure above the vacuum belt, $P_1$. Because the pressure difference is transferred through the holes or perforations in the vacuum belt, the resulting decrease in pressure creates a net pressure from above the vacuum belt that presses the media to the vacuum belt.

At the same time, the high-velocity air below the belt creates an air bearing that allows the vacuum belt to move over the lower baffle with little to no contact. This air flow creates a low friction surface for the vacuum belt to move even when a majority of the holes in the vacuum belt are covered. This reduces the high levels of friction seen on current vacuum belts when they become loaded with media during transport.

The vacuum belt may move opposite to the incoming high-velocity air to provide and maximize the pressure differential. It is understood that if the belt were to travel in the same direction as the forced air the resulting velocity under the vacuum belt could result in a drop in the relative pressure differential from above the vacuum belt to below the vacuum belt. To show this, the resulting equation would be:

$$V_2=V_{Belt}-V_{Forced\ Air} \qquad \text{Equation 4}$$

When the forced air is in the same direction as the belt and approaches the speed of the belt itself, $V_{Belt}=V_{Forced\ Air}$ the result would be $V_{Belt}-V_{Forced\ Air}=0$, or $V_2=0=V_1$.

The fact that velocity is a vector quantity and defined not only by speed but also direction, even if the velocities are not equal, as they approach the same velocity, the relative velocity for air above and below the vacuum belt is reduced and could approach zero as the velocities become equal.

Succinctly put, the disclosed embodiments improve on conventional systems by applying high-velocity forced air directed along the non-item bearing or bottom side of a vacuum belt, i.e., a perforated belt, in a manner that provides a velocity differential of the air above and below the vacuum (perforated) belt that creates a corresponding pressure differential according to Bernoulli's principle. This pressure differential holds the media, packaging, components and the like to the moving vacuum (perforated) belt in a vacuum belt transport system. Employing such a vacuum belt transport system that uses a stream of high-velocity forced air on the opposite side of a perforated belt to provide an air bearing that supports the perforated belt during media transport, while providing a velocity differential that creates a hold down force for the media on the opposite side of the perforated belt may aid in overcoming certain of the shortfalls in conventional vacuum belt transport systems, as outlined above.

The disclosed embodiment may provide an improved functionality of a vacuum belt transport system by eliminating the induced frictional loading associated with traditional vacuum belt transport systems. The disclosed embodiments may decrease the loads on the transport drives by reducing the loading on the vacuum transport belt(s). The disclosed embodiments may provide a more even loading on the vacuum belt transport system by reducing the effect of media presence on the vacuum belt. The disclosed embodiments may reduce complex tensioning and/or complex feedback issues associated with belt stretch due to variable and high loads caused by media covering vacuum holes in traditional vacuum belt transport systems. The disclosed embodiments may reduce stretch especially for longer runs of vacuum belt transport systems.

FIG. 1 illustrates a block diagram of an exemplary image forming system 100 including an advanced vacuum belt transport system 140 according to this disclosure. As shown in FIG. 1, the image forming system 100 may generally include an image receiving media source 110 that supplies substrates of image receiving media 130 in some form to a transport path across a system-facing side of the advanced vacuum belt transport system 140. Generally, the substrates of image receiving media 130 may be transported past a marking engine 115 for the marking engine 115 to form images on the substrates of image receiving media 130. Transport of the substrates of image receiving media 130 may continue past, or through, one or more finishing devices 120. The substrates of image receiving media 130 may then ultimately be deposited in an image receiving media output 125.

The advanced vacuum belt transport system 140 may comprise one or more rollers 142,144 around which a perforated belt 146 may be threaded. One or both of the rollers 142,144 may be powered to act as a drive unit for the advanced vacuum belt transport system 140 and specifically the perforated belt 146. The advanced vacuum belt transport system 140 may further include one or more vacuum belt guides 148 by which motion and/or movement of the perforated belt 146 may be appropriately restricted. The advanced vacuum belt transport system 140 may include a separating space between the one or more vacuum belt guides 148 and the perforated belt 146 as the perforated belt 146 is translated on an operative (in this figure upward) side of the advanced vacuum belt transport system 140.

The separating space between the one or more vacuum belt guides 148 and the perforated belt 146 may have positioned within it at least one high-velocity air flow introducing unit 150 and at least one high-velocity airflow exhausting unit 155. The at least one high-velocity air flow introducing unit 150 and the at least one high-velocity airflow exhausting unit 155 may combine to provide a thin layer of a substantially laminar flow of high-velocity air 160 directed along a bottom side of the perforated belt 146 in an operative area of the advanced vacuum belt transport system 140 substantially in the manner shown in FIG. 1.

As described in requisite detail above, this thin layer of substantially laminar flow of high-velocity air 160 may appropriately act as an air bearing between the perforated belt 146 and the one or more vacuum belt guides 148 minimizing and/or substantially eliminating any otherwise induced frictional forces therebetween, while reducing a pressure in the separating space thereby creating a vacuum through the openings in the perforated belt 146 in the manner described in detail above.

Figure 2:
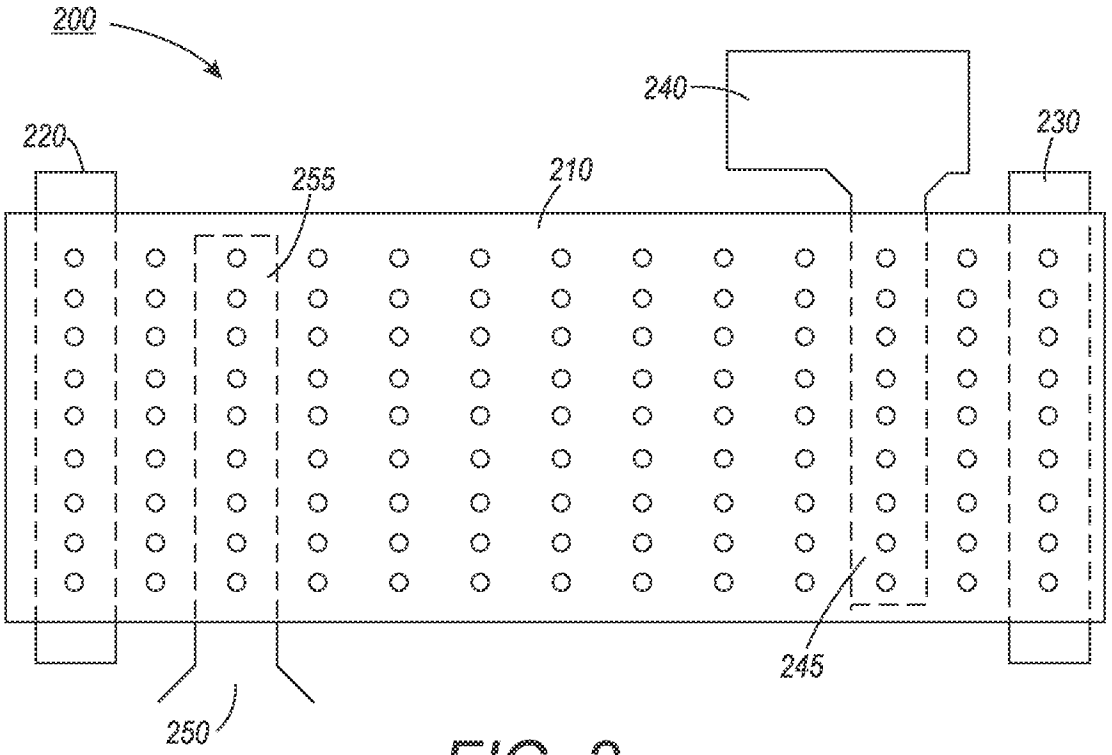
FIG. 2 illustrates a plan view of an exemplary embodiment of an advanced vacuum belt transport system according to this disclosure.

FIG. 2 illustrates a plan view of an exemplary embodiment of an advanced vacuum belt transport system 200 according to this disclosure. As shown in FIG. 2, the exemplary system 200 may include a perforated belt 210 threaded around a plurality of rollers 220,230. As indicated above, one or both of the plurality of rollers 220,230 may be powered in order to facilitate movement of the perforated belt 210 in an operative direction. The exemplary system 200 may include one or more high-velocity airflow introducing units 240 attached to one or more manifolds 245 by which high-velocity forced air may be introduced "under" the perforated belt 210. Cooperatively, the exemplary system 200 may include one or more high-velocity airflow exhausting units 250 by which high-velocity forced air may be exhausted from under the perforated belt 210. It should be noted that the depiction of the high-velocity airflow introducing unit 240 and the high-velocity airflow exhausting unit 250 is not intended to be limiting as portraying that provide a high-velocity airflow and/or exhausting high-velocity airflow must necessarily occur in a particular direction. High-velocity introducing and exhausting units may be positioned at any and varying positions as appropriate to introduce and/or exhaust high-velocity air from under the perforated belt 210. High-velocity air may be individually directed in any manner that may produce a local or overall laminar flow of the high-velocity air under the perforated belt to provide the distinct advantages of introducing an air bearing under the perforated belt 210 and introducing an appropriate vacuum force through the perforations in the perforated belt 210.

Figure 3:
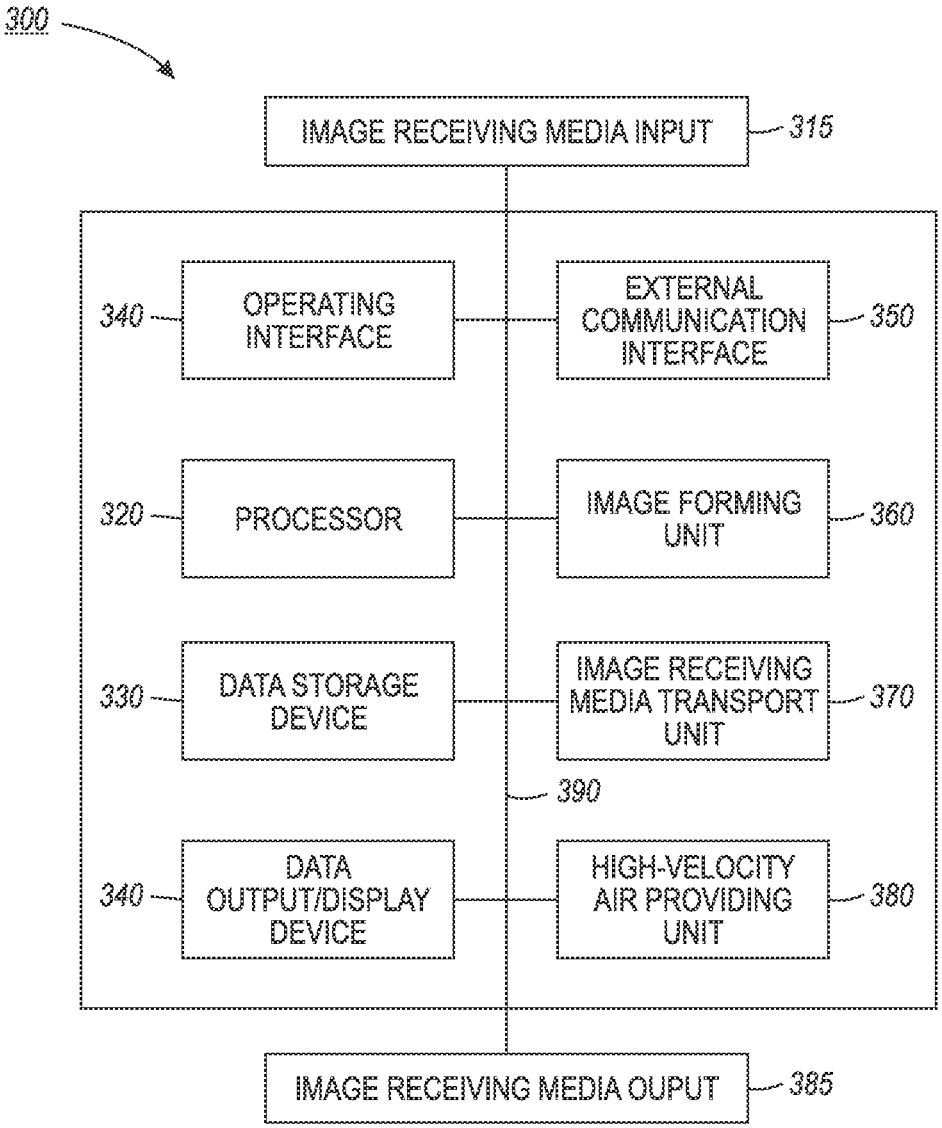
FIG. 3 illustrates a block diagram of an exemplary control system for implementing advanced vacuum belt transport according to this disclosure.

FIG. 3 illustrates a block diagram of an exemplary control system 300 for implementing advanced vacuum belt transport according to this disclosure. As shown in FIG. 3, the exemplary system 300 is usable to manage image forming operations between an image receiving media input 315 and an image receiving media output 385.

The exemplary control system 300 may include an operating interface 310 by which a user may communicate with the exemplary control system 300. The operating interface 310 may be a locally-accessible user interface associated with an image forming device. The operating interface 310 may be configured as one or more conventional mechanisms common to control devices and/or computing devices that may permit a user to input information to the exemplary control system 300. The operating interface 310 may include, for example, a conventional keyboard, a touchscreen with "soft" buttons or with various components for use with a compatible stylus, a microphone by which a user may provide oral commands to the exemplary control system 300 to be "translated" by a voice recognition program, or other like device by which a user may communicate specific operating instructions to the exemplary control system 300. The operating interface 310 may be a part of a function of a graphical user interface (GUI) mounted on, integral to, or associated with, the image forming device with which the exemplary control system 300 is associated.

The exemplary control system 300 may include one or more local processors 320 for individually operating the exemplary control system 300 and for carrying out operating functions of an advanced vacuum belt transport system in an image forming device with which the exemplary control system 300 may be associated. Processor(s) 320 may include at least one conventional processor or microprocessor that interprets and executes instructions to direct specific functioning of the exemplary control system 300.

The exemplary control system 300 may include one or more data storage devices 330. Such data storage device(s) 330 may be used to store data or operating programs to be used by the exemplary control system 300, and specifically the processor(s) 320. Data storage device(s) 330 may be used to store information regarding, for example, particular variable velocities for the high-velocity air introducing and exhausting components. Variable velocities for the high velocity air to be circulated through the system may be selectable according to, for example, a composition of components overlying the plurality of perforations in the perforated belt.

The data storage device(s) 330 may include a random access memory (RAM) or another type of dynamic storage device that is capable of storing updatable database information, and for separately storing instructions for execution of system operations by, for example, processor(s) 320. Data storage device(s) 330 may also include a read-only memory (ROM), which may include a conventional ROM device or another type of static storage device that stores static information and instructions for processor(s) 320. Further, the data storage device(s) 330 may be integral to the exemplary control system 300, or may be provided external to, and in wired or wireless communication with, the exemplary control system 300.

The exemplary control system 300 may include at least one data output/display device 340, which may be configured as one or more conventional mechanisms that output information to a user, including, but not limited to, a display screen on a GUI of the image forming device with which the exemplary control system 300 may be associated. The data output/display device 340 may be used to indicate to a user a status of operation of an image forming device with which the exemplary control system 300 may be associated including an operation of one or more of an advanced vacuum belt transport system and/or an associated high-velocity forced air introduction/removal system.

The exemplary control system 300 may include one or more separate external communication interfaces 350 by which the exemplary control system 300 may communicate with components external to the exemplary control system 300. At least one of the external communication interfaces 350 may be configured as an output port to support connection to, and/or communication with, for example, an image forming device with which the exemplary control system 300 may be associated. Any suitable data connection in wired or wireless communication is contemplated to be encompassed by the depicted external communication interface 350.

The exemplary control system 300 may include an image forming unit 360, an image receiving media transport unit 370 which may include, at least in part, one or more vacuum belt transport systems, and at least one high-velocity air providing unit 380 for executing the image forming and media transport function described in detail above. Each of the image forming unit 360, the image receiving media transport unit 370, and the high-velocity air providing unit 380 may operate as a part of the processor 320 coupled to, for example, one or more data storage devices 330, or as separate standalone component modules or circuits in the exemplary control system 300.

All of the various components of the exemplary control system 300, as depicted in FIG. 3, may be connected internally, and to one or more image forming devices, by one or more data/control busses 390. These data/control busses 390 may provide wired or wireless communication between the various components of the exemplary control system 300, whether all of those components are housed integrally in, or are otherwise external and connected to an image forming device with which the exemplary control system 300 may be associated.

It should be appreciated that, although depicted in FIG. 3 as an integral unit, the various disclosed elements of the exemplary control system 300 may be arranged in any combination of sub-systems as individual components or combinations of components, integral to a single unit, or external to, and in wired or wireless communication with the single unit of the exemplary control system 300. In other words, no specific configuration as an integral unit or as a support unit is to be implied by the depiction in FIG. 3. Further, although depicted as individual units for ease of understanding of the details provided in this disclosure regarding the exemplary control system 300, it should be understood that the described functions of any of the individually-depicted components may be undertaken, for example, by one or more processors 320 connected to, and in communication with, one or more data storage device(s) 330.

Figure 4:
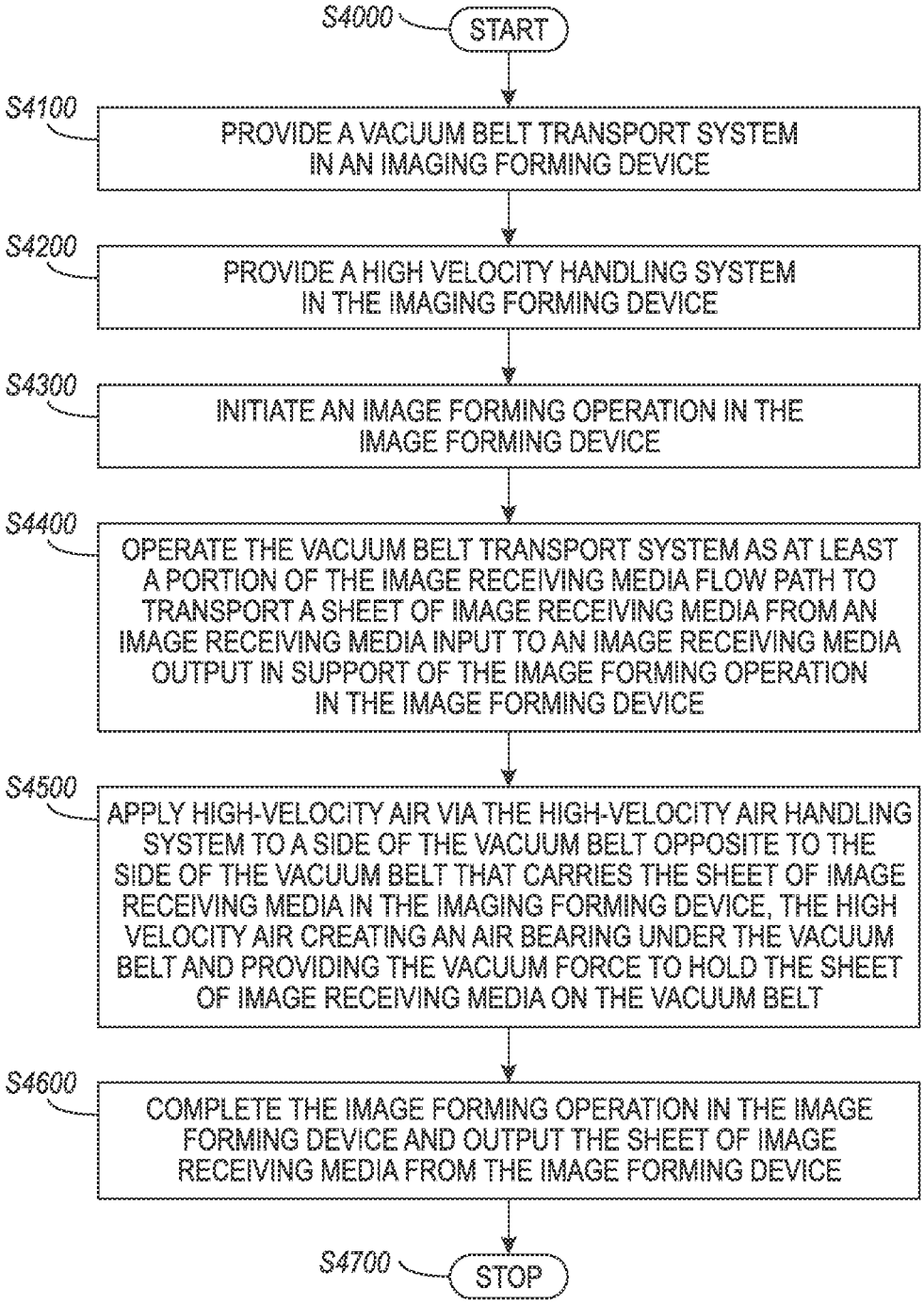
FIG. 4 illustrates a flowchart of an exemplary method for implementing advanced vacuum belt transport according to this disclosure.

The disclosed embodiments may include an exemplary method for implementing advanced vacuum belt transport. FIG. 4 illustrates a flowchart of such an exemplary method. As shown in FIG. 4, operation of the method commences at Step S4000 and proceeds to Step S4100.

In Step S4100, a vacuum belt transport system may be provided in an image forming device. Operation of the method proceeds to Step S4200.

In Step S4200, a high-velocity air handling system associated with the vacuum belt transport system may be provided in the image forming device. Operation of the method proceeds to Step S4300.

In Step S4300, an image forming operation may be initiated in the image forming device. Operation of the method proceeds to Step S4400.

In Step S4400, the vacuum belt transport system may be operated as at least a portion of an image receiving media flow path to transport a sheet of image receiving media from an image receiving media input to an image receiving media output in support of the image forming operations in the image forming device. Operation of the method proceeds to Step S4500.

In Step S4500, high-velocity air may be applied via the high-velocity air handling system to a side of the vacuum belt in the vacuum belt transport system opposite to the side of the vacuum belt that carries the sheet of image receiving media in the image forming device. The high-velocity air may create an air bearing under the vacuum belt, and provide a vacuum force to hold the sheet of image receiving media on the vacuum belt according to, for example, Bernoulli's principle. Operation of the method proceeds to Step S4600.

In Step S4600, as the sheet of image receiving media is translated via the vacuum belt transport system past the individual processing units with which the vacuum belt transport system is associated in the image forming device, the image forming operation may be completed in the image forming device, and the sheet of image receiving media may be output from the image forming device. Operation of the method proceeds to Step S4700, where operation of the method ceases.

As indicated above, the method may positively provide a previously unachievable level of control of the vacuum belt transport system, in support of highest image quality for the images deposited on the substrate transported by the vacuum belt transport system in the image forming device.

The disclosed embodiments may include a non-transitory computer-readable medium storing instructions which, when executed by a processor, may cause the processor to execute all, or at least some, of the steps of the method outlined above.

The above-described exemplary systems and methods reference certain conventional components to provide a brief, general description of suitable operating, product processing and image forming environments in which the subject matter of this disclosure may be implemented for familiarity and ease of understanding. Although not required, embodiments of the disclosure may be provided, at least in part, in a form of hardware circuits, firmware, or software computer-executable instructions to carry out the specific functions described. These may include individual program modules executed by a processor.

Those skilled in the art will appreciate that other embodiments of the disclosed subject matter may be practiced in devices, including image forming devices, of many different configurations.

As indicated above, embodiments within the scope of this disclosure may include computer-readable media having stored computer-executable instructions or data structures that can be accessed, read and executed by one or more processors. Such computer-readable media can be any available media that can be accessed by a processor, general purpose or special purpose computer. By way of example, and not limitation, such computer-readable media can comprise RAM, ROM, EEPROM, CD-ROM, flash drives, data memory cards or other analog or digital data storage device that can be used to carry or store desired program elements or steps in the form of accessible computer-executable instructions or data structures.

Computer-executable instructions include, for example, non-transitory instructions and data that can be executed and accessed respectively to cause a processor to perform certain of the above-specified functions, individually or in various combinations. Computer-executable instructions may also include program modules that are remotely stored for access and execution by a processor.

The exemplary depicted sequence of executable instructions or associated data structures represent one example of a corresponding sequence of acts for implementing the functions described in the steps of the above-outlined exemplary method. The exemplary depicted steps may be executed in any reasonable order to effect the objectives of the disclosed embodiments. No particular order to the disclosed steps of the method is necessarily implied by the depiction in FIG. 4, except where a particular method step is a necessary precondition to execution of any other method step.

Although the above description may contain specific details, they should not be construed as limiting the claims in any way. Other configurations of the described embodiments of the disclosed systems and methods are part of the scope of this disclosure.

It will be appreciated that various of the above-disclosed and other features and functions, or alternatives thereof, may be desirably combined into many other different systems or applications. Also, various alternatives, modifications, variations or improvements therein may be subsequently made by those skilled in the art which are also intended to be encompassed by the following claims.

I claim:

1. A system for transporting components, comprising:

a perforated belt having a first side on which components are transported and a second side opposite the first side;

a plurality of rollers about which the perforated belt is threaded for operation, the plurality of rollers contacting the second side of the perforated belt; and an air movement device that is configured to move a stream of forced air in a direction along and substantially parallel to the second side of the perforated belt, the air movement device creating a substantially laminar flow of air in a space that faces the second side of the perforated belt;

wherein at least one of the plurality of rollers operating to drive the perforated belt to transport components on the perforated belt in a transport direction;

wherein the air movement device being configured to direct the stream of forced air along the second side of the perforated belt in a direction substantially opposite to the transport direction of the perforated belt.

2. The system of claim 1, the movement of the stream of forced air along and substantially parallel to the second side of the perforated belt creating a pressure differential through the perforations for holding transported components on the first side of the perforated belt.

3. The system of claim 1, the stream of forced air creating an air bearing between the second side of the perforated belt and fixed structural components over which the perforated belt moves in operation.

4. The system of claim 1, wherein the air movement device being configured to direct the stream of forced air along the second side of the belt at an oblique angle with respect to the transport direction of the perforated belt.

5. The system of claim 1, the air movement device comprising at least one air supplying unit and at least one air directing manifold associated with the at least one air supplying unit.

6. The system of claim 5, the air movement device further comprising at least one air exhaust unit.

7. An image forming device, comprising:

an image receiving media supply component;

a media marking unit for producing images on an image receiving media substrate; and an image receiving media transport system for transporting individual image receiving media substrates in a transport direction from the image receiving media supply component past the media marking unit for images to be produced thereon, the image receiving media transport system, comprising:

a perforated belt having a first side on which the individual image receiving media substrates are transported and a second side opposite the first side;

a plurality of rollers about which the perforated belt is threaded for operation, the plurality of rollers contacting the second side of the perforated belt; and an air movement device that is configured to move a stream of forced air in a direction along and substantially parallel to the second side of the perforated belt, the air movement device creating a substantially laminar flow of air in a space that faces the second side of the perforated belt;

wherein the air movement device being configured to direct the stream of forced air along the second side of the perforated belt in a direction substantially opposite to the transport direction of the perforated belt.

8. The image forming device of claim 7, the movement of the stream of forced air along and substantially parallel to the second side of the perforated belt creating a pressure differential through the perforations for holding the individual image receiving media substrates on the first side of the perforated belt.

9. The image forming device of claim 7, the stream of forced air creating an air bearing between the second side of the perforated belt and fixed structural components in the image forming device and the air movement device over which the perforated belt moves in operation.

10. The image forming device of claim 7, wherein at least of one of the plurality of rollers operating to drive the perforated belt to transport the individual image receiving media substrates on the perforated belt in the transport direction.

11. The image forming device of claim 7, the air movement device being configured to direct the stream of forced air along the second side of the belt at an oblique angle with respect to the transport direction of the perforated belt.

12. The image forming device of claim 7, the air movement device comprising at least one air supplying unit and at least one air directing manifold associated with the at least one air supplying unit.

13. The image forming device of claim 12, the air movement device further comprising at least one air exhaust unit.

14. A method for transporting components, comprising:

providing a perforated belt having a first side on which components are transported and a second side opposite the first side, the perforated belt being threaded around a plurality of rollers for operation, the plurality of rollers contacting the second side of the perforated belt; and moving a stream of forced air in a direction along and substantially parallel to the second side of the perforated belt using an air movement device that creates a substantially laminar flow of air in a space that faces the second side of the perforated belt;

driving at least one of the plurality of rollers to, in turn, drive the perforated belt to transport components on the perforated belt in a transport direction;

directing the stream of forced air along the second side of the perforated belt in a direction substantially opposite to the transport direction of the perforated belt.

15. The method of claim 14, further comprising creating a pressure differential through perforations in the perforated belt with the movement of the stream of forced air along and substantially parallel to the second side of the perforated belt, the pressure differential holding transported components on the first side of the perforated belt.

16. The method of claim 14, further comprising creating an air bearing between the second side of the perforated belt and fixed structural components over which the perforated belt moves in operation with the stream of forced air.

17. The method of claim 14, further comprising directing the stream of forced air along the second side of the belt at an oblique angle with respect to the transport direction of the perforated belt.

* * * * *